United States Patent [19]

Acke

[11] Patent Number: 4,561,716

[45] Date of Patent: Dec. 31, 1985

[54] COAXIAL CONNECTOR

[75] Inventor: Edgar Acke, Oostkamp, Belgium

[73] Assignee: Siemens Aktiengesellschaft, Berlin and Munich, Fed. Rep. of Germany

[21] Appl. No.: 557,771

[22] Filed: Dec. 2, 1983

[30] Foreign Application Priority Data

Dec. 21, 1982 [DE] Fed. Rep. of Germany ... 8235915[U]

[51] Int. Cl.[4] ..... H01R 17/18

[52] U.S. Cl. ..... 339/177 R; 339/256 R; 339/258 R

[58] Field of Search ..... 339/177, 255 R, 256 R, 339/258 R, 258 RR

[56] References Cited

U.S. PATENT DOCUMENTS

| | | | |
|---|---|---|---|
| 3,253,250 | 5/1966 | Harrison et al. | 339/258 R |
| 3,296,363 | 1/1967 | Laudig et al. | 339/177 R |
| 3,439,294 | 4/1969 | Flanagan et al. | 339/177 R |
| 3,521,222 | 7/1970 | Andrews | 339/143 |
| 4,227,765 | 10/1980 | Neumann et al. | 339/177 E |
| 4,290,663 | 9/1981 | Fowler et al. | 339/177 R |
| 4,408,822 | 10/1983 | Nikitas | 339/177 R |

FOREIGN PATENT DOCUMENTS 1813161 6/1959 Fed. Rep. of Germany .

*Primary Examiner*—Gil Weidenfeld
*Assistant Examiner*—David L. Pirlot
*Attorney, Agent, or Firm*—Thomas H. Jackson

[57] ABSTRACT

An improved coaxial connector which has a first half with a first outer connector sleeve arranged therewith and a second half with a second outer connector sleeve arranged therewith. The first outer connector sleeve is divided by means of axis parallel slots into contact fingers which are evenly distributed over the circumference of the first sleeve. Each finger terminates with a projection at its free end so that all the projections define a ringshaped bead. In the unplugged condition of the connector the contact fingers are in exact parallel alignment with the longitudinal axis of the connector and they are not subjected to any prebending. The second sleeve is provided with a mouth section which has a conical opening. The contact fingers are inserted into the second sleeve by engaging the mouth section. The outside diameter of the projection of the contact fingers is larger than the inside diameter of the second conductor sleeve, but smaller than the maximum diameter of the mouth section. As the contact fingers are inserted into the second sleeve they are being bent inwardly. In this manner, the contact fingers of the first conductor sleeve can be produced without any prebending so that operations related to such prebending can be avoided. The projection of the contact fingers are laterally curved to match the inside contour of the second sleeve. Due to the obliqueness of the contact fingers in the plugged-in condition of the connector there is also capacitive compensation for inductive interference zones in the plug area.

1 Claim, 5 Drawing Figures

COAXIAL CONNECTOR

BACKGROUND OF THE INVENTION

The invention relates to a coaxial connector. In particular, to a coaxial connector with two connector halves in which an outer conductor sleeve associated with the first connector half is divided, by means of axis-parallel slots, into contact fingers evenly distributed over the circumference of the sleeve. Each of the free ends of the freely extending contact fingers is provided with a projection which is directed radially outward. The projections of all the fingers together form a ringshaped contact bead. Another conductor sleeve associated with the second conductor half is provided with a mouth section whose inside diameter expands conically so that the first conductor sleeve is pluggable, fingers first, via the mouth section into the outer conductor sleeve of the second connector itself. The outside diameter of the contact bead when left unplugged, is smaller than the maximum inside diameter of the mouth section, but larger than the inside diameter of the second outer conductor sleeve itself.

Such a coaxial connector is known, for example, from German patent document No. DE-GM 18 13 161. In such a connector, the contact fingers of one connector half are slightly prebent outwardly. When plugging the two connector halves of such a connector together, the contact fingers become aligned parallel to the axis of the outer conductor sleeve associated with it. The projections of the contact fingers contact, by spring action, the inside wall of the other outer conductor sleeve, thereby forming with the other outer conductor sleeve a direct electrical contact. However, such a coaxial connector does not make it easy to provide all contact fingers with the same prebend. Moreover, it is often necessary to product the outer conductor sleeve, at least in the contact finger area, of a special spring material such as beryllium copper in order to obtain an adequate contact force considering the relatively short spring motions of the contact fingers.

SUMMARY OF THE INVENTION

Therefore, it is an object of the invention to provide a coaxial connector of the type referred to above so that its production can be simplified considerably.

According to the invention, this problem is solved in that the contact fingers, in the unplugged condition of the connector, are disposed parallel to the sleeve axis without any prebend whatever.

Consequently, the contact fingers can be produced without any prebend whatever so that the contact sleeve need not consist of more expensive material in the contact finger area. Moreover, due to a gradual decrease in the distance between the contact fingers and the inner conductors of the connector an advantageous capacitive compensation results which reduces the inductive interference zones in the plug area. These undesirable zones may be attributed to, for example, the slots in an inner conductor sleeve and to the slots between the contact fingers and/or to the axial gap between an inner conductor bushing and an inner conductor plug of the connector.

A coaxial connector is disclosed in German patent document No. DE-AS 18 05 039 in which spoonshaped contact fingers, prebent outwardly at their ends and fastened to an outer conductor sleeve, are pushed inwardly by pushing another outer conductor sleeve over them. The outermost ends of these contact fingers are elastically supported in the unplugged condition of the connector by an undercut in the outer conductor sleeve associated with them. However, the disclosed connector, is of a relatively complicated design and it does not and cannot provide the capacitance compensation effects of the contact fingers in accordance with the present invention.

In a further embodiment of the invention, the outside diameter of one conductor sleeve is slightly smaller in the area of the contact fingers outside of the contact bead than the inside diameter of the outer conductor sleeve in a hollow-cylindrical section adjacent to the latter's mouth section. Furthermore, the outside surface of the contact finger projections are laterally curved and have a radius of curvature in the area of the contact bead which is equal to one half the inside diameter of the second outer conductor sleeve in the latter's hollow-cylindrical section.

This creates a clear and direct contact between the two outer conductor sleeves because contact is now made in the form of a direct connection which is capable of transmitting DC current between the projections of the contact fingers and the second outer conductor sleeve.

Other features and advantages of the invention will be apparent from the following description of the preferred embodiments, and from the claims.

For a full understanding of the present invention, reference should now be made to the following detailed description of the preferred embodiments of the invention and to the accompanying drawings.

DETAILED DESCRIPTION OF THE DRAWINGS

Preferred embodiments of the invention will now be described by reference to the FIGS. 1–3 4A and 4B.

Figure 1:
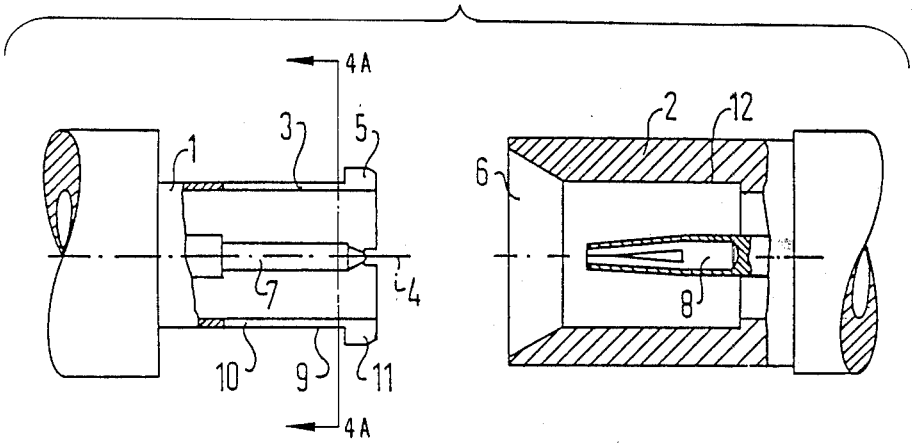
FIG. 1 shows the two connector halves in an unplugged condition and provides details of the contact fingers and the mouth section.
Figure 2:
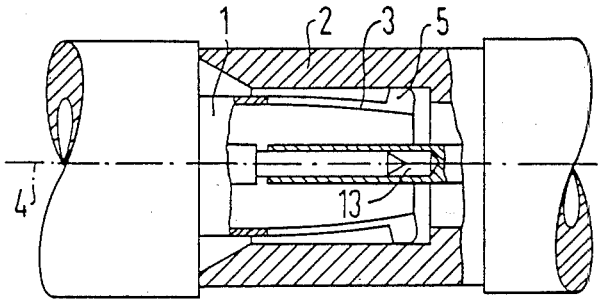
FIG. 2 shows the two connector halves in a plugged condition.
Figure 3:
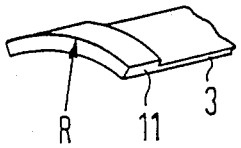
FIG. 3 shows the curvature which is characteristic of each projection of a contact finger according to a preferred embodiment.
Figure 4A:
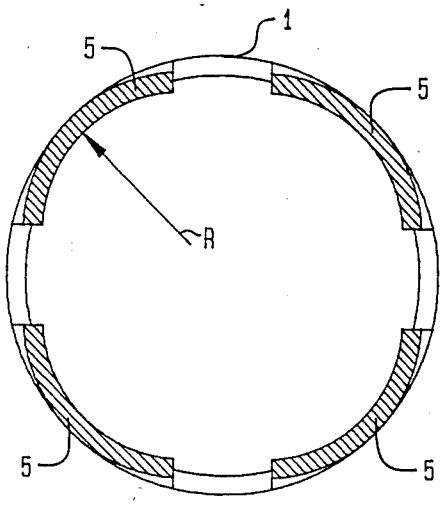
FIGS. 4A and 4B show an end view of the contact finger projections in the plugged and unplugged conditions.
Figure 4B:
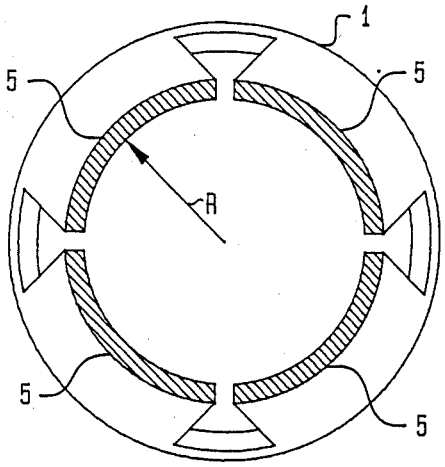

In FIG. 1, it is shown that each connector half of the coaxial connector consists of an outer conductor sleeve 1 and 2 respectively and an inner conductor contact member 7 and 8 respectively.

The outer conductor sleeves 1 and 2 are connected in a manner not shown in detail, to the outer conductor of a coaxial cable while the inner conductor contact members 7 and 8 are connected to the inner conductors of their respective coaxial cables.

In order to establish between the two outer conductor sleeves 1 and 2 a perfect high-frequency effective contact, the outer conductor sleeve 1 associated with the one connector half is divided, in a section 9 facing the outer conductor sleeve 2 of the other connector half, into contact fingers 3 by introducing cutouts or slots 10 which are parallel to the axis 4 of the connector half. The contact fingers 3 are evenly distributed over the circumference of the outer conductor sleeve 1.

At their free ends, the contact fingers have projections 5 which are directed radially outward and, together, form a ringshaped contact bead 11.

An important feature of the coaxial connector according to the present invention resides in that the contact fingers 3 extend parallel to the axis 4 of the outer conductor sleeve 1 without the necessity that the fingers be provided with any prebend or preload. In fact the fingers 3 remain in the state in which they originated from the outer conductor sleeve 1.

The outer conductor sleeve 2 of the other connector half is provided, on its side facing the contact fingers 3 with a mouth section 6. In the mouth section area the inside diameter of the contact sleeve 2 expands conically. The largest inside diameter of the mouth section 6 is greater than the maximum outside diameter of the ringshaped bead 11 formed by the projections 5 of the individual contact fingers 3. On the other hand, the inside diameter of the outside conductor sleeve 2 is slightly smaller, in an area 12 of the outer conductor sleeve 2 adjoining the mouth section and defining a hollowed cylindrical section, than the outside diameter of the ringshaped bead 11.

Consequently, the tapered mouth section 6 pushes the projections 5 of the contact fingers 3 toward the axis 4 of sleeve 1 when the two outer conductor sleeves are plugged into each other. This causes the ends of the fingers 3 to be bent towards the axis 4. Consequently, the projections 5 are pressed elastically against the inside wall of the sleeve 2 when the sleeve 1 with its contact fingers 3 is pushed into the sleeve 2 until the final position when the two sleeves have been properly connected.

In this way, the contact fingers 3 inside the sleeve 2 are curved slightly inwardly towards their free ends, thereby decreasing the distance between the sleeve 1 and the mated contact members 7 and 8 of the connector.

The capacitively acting interference thus generated in the plug area advantageously compensates for inductive interference zones formed. For instance, these zones are generated by the slots 10 in the outer conductor sleeve 1 and by the inner conductor bushing 8 as well as by the gap 13 between the inner conductor bushing 8 and the inner conductive pin 7.

Because the individual sections or members of the ringshaped bead 11 are provided at the free end of the contact fingers 3 with an outer radius of curvature R corresponding to half the inside diameter of the outer conductor sleeve 2 in the hollow-cylindrical section 12 it is assured that a perfect ring contact is formed between the contact bead 11 and the outer conductor sleeve 2. This is true even though the contact fingers are being bent towards the axis of the connector when the two connector halves are plugged into each other.

There has thus been shown and described a novel coaxial connector which fulfills all the objects and advantages sought therefor. Many changes, modifications, variations and other uses and applications of the subject invention will, however, become apparent to those skilled in the art after considering the specification and the accompanying drawings which disclose preferred embodiments thereof. All such changes, modifications, variations and other uses and applications which do not depart from the spirit and scope of the invention are deemed to be covered by the invention which is limited only by the claims which follow.

What is claimed is:

1. In a coaxial connector comprising a first connector half with a first outer conductor sleeve arranged therewith and a second connector half with a second outer conductor sleeve, wherein said first sleeve, in a section facing said second sleeve, is divided, by means of axis-parallel slots into contact fingers evenly distributed over the circumference of said first sleeve each one of said fingers being provided at their free ends with a projection which is directed radially outward, said projections together defining a ringshaped bead, said second outer conductor sleeve comprising a mouth section with an inside diameter which expands conically, and a hollow cylindrical section adjoining the mouth section, said first sleeve being pluggable via said mouth section into said second conductor sleeve, said contact fingers engaging said mouth section first, said ringshaped bead having, in its unplugged condition, an outside diameter which is smaller than the maximum inside diameter of said mouth section but larger than the inside diameter of said second outer conductor sleeve, an improvement which is comprised in that: said contact fingers extend, in their unplugged condition, parallel to the longitudinal axis of said first outer conductor sleeve, and further being straight and free of any prebend, said contact fingers are curved slightly inwardly towards their free ends in their plugged condition, thereby decreasing the distance between said first sleeve and mated inner conductors of said connector and the projections of the contact fingers are laterally curved, their outer radius of curvature being essentially equal to half the inside diameter of the hollow cylindrical section of the second conductor sleeve but less than the radius of curvature of the contact fingers at their respective fixed end such that as the respective projections are radially inwardly deflected their outer radii of curvature converge to form a conforming ring contact with an outer diameter equal to the diameter of the hollow cylindrical section of the second conductor sleeve.

* * * * *